US010428437B2

(12) United States Patent
Werner et al.

(10) Patent No.: US 10,428,437 B2
(45) Date of Patent: Oct. 1, 2019

(54) WEAR-RESISTANT COATING PRODUCED BY ELECTRODEPOSITION AND PROCESS THEREFOR

(71) Applicant: MTU Aero Engines AG, Munich (DE)

(72) Inventors: André Werner, Munich (DE); Josef Linska, Grafing (DE)

(73) Assignee: MTU AERO ENGINES AG, Munich (DE)

( * ) Notice: Subject to any disclaimer, the term of this patent is extended or adjusted under 35 U.S.C. 154(b) by 725 days.

(21) Appl. No.: 14/484,459

(22) Filed: Sep. 12, 2014

(65) Prior Publication Data

US 2015/0075327 A1 Mar. 19, 2015

(30) Foreign Application Priority Data

Sep. 18, 2013 (DE) ..... 10 2013 218 687

(51) Int. Cl.
*B22F 1/00* (2006.01)
*C25D 15/00* (2006.01)
(Continued)

(52) U.S. Cl.
CPC ..... *C25D 15/00* (2013.01); *B22F 1/0003* (2013.01); *C22C 19/058* (2013.01); *C22C 19/07* (2013.01); *C22C 27/06* (2013.01); *C22C 30/00* (2013.01); *C25D 3/12* (2013.01); *C25D 3/562* (2013.01); *C25D 5/50* (2013.01);
(Continued)

(58) Field of Classification Search
None
See application file for complete search history.

(56) References Cited

U.S. PATENT DOCUMENTS 4,895,625 A 1/1990 Thoma et al.
5,064,510 A 11/1991 Thoma et al.
(Continued)

FOREIGN PATENT DOCUMENTS

DE 3815976 A1 11/1989
DE 102006016995 A1 10/2007
(Continued)

OTHER PUBLICATIONS

Johnston, R. E., "Mechanical characterisation of AlSi—hBN, NiCrAl-Bentonite, and NiCrAl-Bentonite-hBN freestanding abradable coatings", Nov. 2010, Surface & Coatings Technology, vol. 205, pp. 3268-3273.*
(Continued)

*Primary Examiner* — Seth Dumbris
(74) *Attorney, Agent, or Firm* — Abel Schillinger, LLP

(57) ABSTRACT

Disclosed is process for producing a wear-resistant coating on a component. The process comprises providing an electrolyte which contains Co and/or Ni, dispersing first particles comprising hard material particles and/or slip material particles in the electrolyte, dispersing second particles comprising metal alloy particles in which the metal alloy comprises chromium and aluminum in the electrolyte, providing a component to be coated in a bath of the electrolyte which has first and second particles dispersed therein, and electrodepositing a matrix of Co and/or Ni with incorporated first and second particles on the component. A correspondingly produced wear-resistant coating is also disclosed.

18 Claims, 1 Drawing Sheet

(51) Int. Cl.

| | |
|---|---|
| ***C25D 3/12*** | (2006.01) |
| ***C22C 19/05*** | (2006.01) |
| ***C22C 19/07*** | (2006.01) |
| ***C22C 30/00*** | (2006.01) |
| ***C22C 27/06*** | (2006.01) |
| ***C25D 3/56*** | (2006.01) |
| ***C25D 5/50*** | (2006.01) |

(52) U.S. Cl.
CPC ..... *B22F 2301/052* (2013.01); *B22F 2301/15* (2013.01); *B22F 2301/20* (2013.01); *Y10T 428/12049* (2015.01); *Y10T 428/12056* (2015.01)

(56) References Cited

U.S. PATENT DOCUMENTS

| | | | | |
|---|---|---|---|---|
| 5,076,897 | A * | 12/1991 | Wride | B24D 99/00 205/110 |
| 5,536,022 | A * | 7/1996 | Sileo | C23C 4/02 277/415 |
| 5,601,933 | A * | 2/1997 | Hajmrle | C23C 4/06 416/219 R |
| 5,935,407 | A | 8/1999 | Nenov et al. | |
| 6,194,086 | B1 | 2/2001 | Nenov et al. | |
| 6,916,529 | B2 * | 7/2005 | Pabla | C23C 4/02 416/241 R |
| 8,431,238 | B2 | 4/2013 | Payne et al. | |
| 2004/0208749 | A1 | 10/2004 | Torigoe et al. | |
| 2007/0227299 | A1 * | 10/2007 | Marchiando | B22F 3/115 75/244 |
| 2007/0281176 | A1 * | 12/2007 | Palumbo | A01K 87/00 428/457 |
| 2009/0136740 | A1 * | 5/2009 | Reynolds | C23C 4/06 428/325 |
| 2009/0208775 | A1 | 8/2009 | Payne et al. | |
| 2009/0297720 | A1 * | 12/2009 | Ramgopal | C23C 4/06 427/455 |
| 2009/0311552 | A1 | 12/2009 | Manier et al. | |
| 2012/0099971 | A1 * | 4/2012 | Bintz | C23C 28/022 415/173.6 |
| 2013/0330572 | A1 | 12/2013 | Staschko et al. | |

FOREIGN PATENT DOCUMENTS

| | | | | |
|---|---|---|---|---|
| DE | 102007057197 | * | 6/2008 | F16H 63/32 |
| DE | 102010024224 | A1 | 12/2011 | |
| DE | 102010040469 | B3 | 1/2012 | |
| EP | 0424863 | A1 | 5/1991 | |
| EP | 0484115 | A1 | 5/1992 | |
| EP | 1408197 | A1 | 4/2004 | |
| EP | 2096194 | A2 | 9/2009 | |
| GB | 2182055 | A | 5/1987 | |
| WO | 8200162 | A1 | 1/1982 | |
| WO | 9924647 | A1 | 5/1999 | |
| WO | 2008034774 | A2 | 3/2008 | |

OTHER PUBLICATIONS

Ricci, Tom, "Modern Applications of Tribology", Oct. 2011, ASME.org, https://www.asme.org/engineering-topics/articles/tribology/modern-application-of-tribology, pp. 1-4.*

* cited by examiner

WEAR-RESISTANT COATING PRODUCED BY ELECTRODEPOSITION AND PROCESS THEREFOR

CROSS-REFERENCE TO RELATED APPLICATIONS

The present application claims priority under 35 U.S.C. § 119 of German Patent Application No. 102013218687.8, filed Sep. 18, 2013, the entire disclosure of which is expressly incorporated by reference herein.

BACKGROUND OF THE INVENTION

1. Field of the Invention

The present invention relates to a wear-resistant coating produced by electrodeposition and also to a corresponding process for the production thereof 2. Discussion of Background Information In turbomachines, such as stationary gas turbines or aero engines, certain components are exposed to high temperatures and aggressive media which necessitate appropriate protection for the components, for example through coatings. Accordingly, it is known to provide components in turbomachines with various coatings which are used for different purposes, for example layers which protect against hot gas corrosion, wear-resistant coatings and the like.

Known high-temperature wear-resistant layers usually comprise hard materials, which can withstand the wear. High-temperature wear-resistant layers of this type are applied according to the prior art by build-up welding or thermal spraying. However, not all regions of a component are accessible for the application of a corresponding high-temperature wear-resistant layer by thermal spraying or build-up welding, and undesirable inhomogeneities may arise in the region of the wear-resistant layers or of the underlying base material as a result of locally different thermal loading of the component during the thermal spraying or build-up welding.

It would therefore be advantageous to have available a process for producing a high-temperature wear-resistant layer, in particular for components of turbomachines, and also corresponding wear-resistant layers, in the case of which no inhomogeneous thermal loading of the component to be coated is generated and in particular it is also possible to coat the component at regions which are difficult to access.

In addition, the corresponding process should make it possible to achieve a homogeneous wear-resistant coating with a good bond strength on the component to be coated, and it should be possible for the corresponding process to be carried out as easily and effectively as possible.

SUMMARY OF THE INVENTION

The present invention provides a process for producing a wear-resistant coating on a component, for example a component of a turbomachine. The process comprises:

providing an electrolyte, which contains Co and/or Ni, dispersing first particles in the electrolyte, the first particles comprising hard material particles and/or slip material particles, dispersing second particles in the electrolyte, the second particles comprising metal alloy particles in which the metal alloy comprises chromium and aluminum, providing the component to be coated in a bath of the electrolyte which has been dispersed with first and second particles, and electrodepositing a matrix of Co and/or Ni with incorporated metal alloy particles and incorporated hard material particles and/or slip material particles on the component.

In one aspect of the process, after the electrodeposition of a matrix of Co and/or Ni with incorporated metal alloy particles and incorporated hard material particles and/or slip material particles on the component, the component may be subjected to a heat treatment. For example, the heat treatment may be carried out in vacuo and/or at a temperature of from 950° C. to 1200° C., for example of from 1000° C. to 1150° C., for from 2 to 20 h, for example for from 5 to 15 h.

In another aspect, the electrolyte may comprise $NiSO_4$ and/or $CoSO_4$ and/or the electrolyte may comprise NaCl and/or $H_3BO_3$.

In yet another aspect, the metal alloy of the metal alloy particles may be selected from CrAl, CrAlY, CrAlHf, CrAlYHf, CrAlTa, CrAlYTa, CrAlSi, MoCrSiAl, CrCoAl, CrNiAl, and from alloys comprising Cr and Al which comprise at least one or more elements selected from Y, Hf, Ta, Si, Mo, Ni, Co.

In a still further aspect of the process of the present invention, the first and second particles may each be provided in a proportion of 50 g/l to 300 g/l of electrolyte.

In another aspect, the first particles may have a maximum or average particle size of less than or equal to 10 μm, in particular of from 1 μm to 5 μm and/or the second particles may have a maximum or average particle size of less than or equal to 15 μm, in particular of from 1 μm to 5 μm.

In another aspect of the process, the first particles may have a metallic shell, for example, a shell which comprises or is formed from Ni and/or Co and/or the slip material particles may comprise solid lubricants, for example hexagonal boron nitride and/or the hard material particles may comprise oxides, for example chromium oxide and/or zirconium oxide.

The present invention also provides a wear-resistant coating having a matrix which comprises Co and/or Ni and also Cr and Al and in which hard material particles and/or slip material particles are incorporated. The coating is obtained by the process of the present invention as set forth above (including the various aspects thereof).

In one aspect of the coating, the hard material particles and/or slip material particles may be present in the in a proportion of from 5% by volume to 40% by volume, for example from 10% by volume to 30% by volume.

In another aspect of the coating, the matrix may contain from 15% by weight to 50% by weight, for example from 20% by weight to 40% by weight, of Co and/or from 15% by weight to 50% by weight, for example from 20% by weight to 40% by weight, of Ni, from 10% by weight to 30% by weight, for example from 10% by weight to 25% by weight, of Cr and from 1% by weight to 10% by weight, for example from 2% by weight to 8% by weight, of Al.

The present invention is based on the concept that a wear-resistant coating comprising hard material particles and/or slip material particles can be produced by an electrodeposition process, it being possible for the hard material particles and/or slip material particles to be dispersed in a corresponding electrolyte bath. In this respect, the invention builds upon the fact that it is already known to electrodeposit hot gas corrosion layers, as is described for example in EP 0 424 863 A1, DE 38 15 976 A1 and U.S. Pat. No. 4,895,625

A, the entire disclosures of which are incorporated by reference herein. What is correspondingly proposed is a wear-resistant coating having an MCrAl matrix, where M stands for Co and/or Ni, in which hard material particles and/or slip material particles are incorporated in the matrix.

The hard material particles and/or slip material particles can be present together in the wear-resistant coating in a proportion of 5% by volume to 40% by volume, in particular 10% by volume to 30% by volume, and the matrix of the wear-resistant coating can contain 15% by weight to 50% by weight, in particular 20% by weight to 40% by weight, cobalt and/or 15% by weight to 50% by weight, in particular 20% by weight to 40% by weight, nickel, 10% by weight to 30% by weight, in particular 10% by weight to 25% by weight, chromium and 1% by weight to 10% by weight, in particular 2% by weight to 8% by weight, aluminum The numerical information for the composition is to be understood here as meaning that the composition of course always gives 100% by weight, in which case the constituents are to be selected within the indicated ranges and any further alloying constituents have to be added. If, for example, both cobalt and nickel are provided in the matrix of the wear-resistant coating, the maximum values of the indicated ranges, that is 50% by weight in each case, cannot be implemented, since at least 10% by weight chromium and 1% by weight aluminum furthermore have to be present. If, however, merely cobalt is present in the matrix, for example, the cobalt content can be selected throughout the indicated range, since additional alloying constituents can be present in addition to the further constituents indicated, chromium and aluminum In order to correspondingly obtain the respective constituents of the wear-resistant coating, the corresponding components can be used in suitable concentrations or quantities in the process for producing a wear-resistant coating as defined hereinbelow.

In order to produce the MCrAl matrix of the desired wear-resistant coating, provision is made according to the invention of an electrolyte containing cobalt and/or nickel. First particles are dispersed in this electrolyte, the first particles comprising hard material particles and/or slip material particles. In addition, second particles are dispersed into the electrolyte, the second particles comprising metal alloy particles in which the metal alloy comprises chromium and aluminum The first particles serve for the introduction of the hard material particles and/or slip material particles provided in the wear-resistant coating to be produced, while the second particles in the form of the metal alloy particles serve to form the MCrAl matrix together with the electrolytes containing cobalt and/or nickel.

A correspondingly prepared electrolyte, in which the first and second particles are dispersed, is used for the electrodeposition of a layer on a component to be coated. The electrodeposited layer consequently comprises a matrix of cobalt and/or nickel in accordance with the composition of the electrolyte and also incorporated first and second particles.

The electrodeposited coating can be subjected to a heat treatment, in which the incorporated metal alloy particles are dissolved and, together with the deposited matrix of cobalt and/or nickel, form a corresponding MCrAl matrix, in which M is formed by cobalt and/or nickel.

The heat treatment can be carried out at a temperature of 950° C. to 1200° C., in particular of from 1000° C. to 1150° C., for from 2 to 20 hours, in particular from 5 to 15 hours.

The heat treatment can be carried out in vacuo, it being possible for the component and electrodeposited layer together to be exposed homogeneously to the corresponding temperature. Alternatively, the electrodeposited layer can also be locally heated by surface heating.

The electrolyte containing cobalt and/or nickel for the electrodeposition may comprise nickel sulfate and/or cobalt sulfate. Furthermore, sodium chloride and/or boric acid may be present in the electrolyte.

The metal alloy of the metal alloy particles may be formed by CrAl, CrAlY, CrAlHf, CrAlYHf, CrAlTa, CrAlYTa, CrAlSi, MoCrSiAl, CrCoAl, CrNiAl and by alloys comprising chromium and aluminum which comprise at least one or more elements selected from yttrium, hafnium, tantalum, silicon, molybdenum, nickel, cobalt.

The first and second particles, i.e. the hard material particles and/or slip material particles, and also the metal alloy particles may each be provided in a proportion of 50 g/l to 300 g/l in the electrolyte, it preferably being the case that an overall quantity of particles in the range of 300 g/l to 400 g/l is not to be exceeded.

The first particles may have a maximum or average particle size of less than or equal to 10 μm, in particular of from 1 μm to 5 μm, while the second particles may have a maximum or average particle size of less than or equal to 15 μm, in particular of from 1 μm to 5 μm.

The first particles in the form of hard material particles and/or slip material particles may have a metallic shell, in particular a shell which comprises or is formed from nickel and/or cobalt, in order to improve the introduction of the hard material particles and/or slip material particles in the electroplating process with a dispersed electrolyte.

The first particles may comprise slip material particles in the form of solid lubricants, in particular in the form of hexagonal boron nitride, in order to reduce the wear by an improved sliding movement of the coating with the wear partners.

The first particles in the form of hard material particles may be formed by oxides, in particular chromium oxide or zirconium oxide, which protect the underlying component by virtue of their hardness and therefore resistance to the wear partners.

As a whole, the invention makes it possible to provide a wear-resistant coating which is suitable in particular for turbomachines, has an MCrAl matrix with incorporated hard material particles and/or slip material particles and can be applied uniformly to a component, even at points which are difficult to access, without inadmissible, in particular inhomogeneous, thermal loading.

BRIEF DESCRIPTION OF THE DRAWINGS

The accompanying drawings show, in a purely schematic manner, in

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show details of the present invention in more detail than is necessary for the fundamental understanding of the present invention, the description in combination with the drawings making apparent to those of skill in the art how the several forms of the present invention may be embodied in practice.

Figure 1:
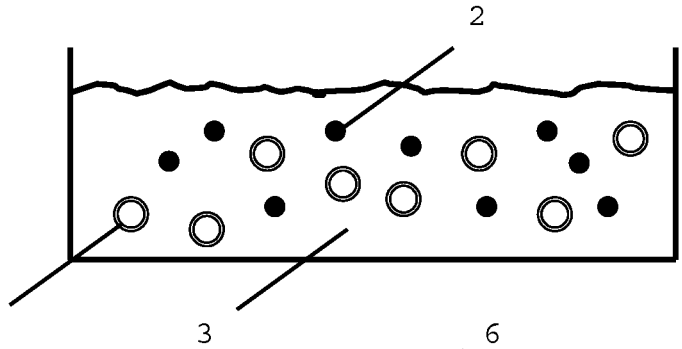
FIG. 1 a cross-sectional view of an electrolyte bath dispersed according to the invention.

FIG. 1 shows an electrolyte 3 in an electrolyte bath, in which first particles 1 and second particles 2 are dispersed.

The electrolyte is a mixture of cobalt sulfate, nickel sulfate, boric acid and sodium chloride, it being possible to use, for example, 240 g/l cobalt sulfate, 240 g/l nickel sulfate, 35 g/l boric acid and 20 g/l sodium chloride. The pH value of the electrolyte is set between 4.5 and 4.7.

The first particles 1, which are dispersed into the electrolyte 3, are hard material particles and/or slip material particles. The hard material particles can be formed by oxides, and in the present preferred exemplary embodiment the hard material particles are formed by chromium oxide or zirconium oxide, which are added to the electrolyte in the form of particles having average particle sizes of 5 μm in a quantity of 100 g/l. In addition, the first particles are formed by slip material particles, which are formed by a solid lubricant, for example hexagonal boron nitride. The slip material particles are likewise dispersed in the electrolyte with an average particle size of 5 μm in a concentration of 100 g/l.

The second particles 2, which are present in the electrolyte 3, are metal alloy particles containing at least chromium and aluminum, in particular predominantly chromium and aluminum Predominantly in this respect means that the sum total of the proportions of chromium and aluminum forms the largest alloying constituent of the metal alloy particles, in particular makes up more than 50% by weight of the metal alloy of the metal alloy particles.

The second particles 2 can likewise be dispersed into the electrolyte 3 with an average particle size of 5 μm in a quantity of 200 g/l.

The electrolyte is brought to a temperature of 30° C. to 70° C. and kept in motion by suitable stirring instruments or the like, so that the dispersed first and second particles 1, 2 are present in a uniform distribution in the electrolyte 3.

Figure 2:
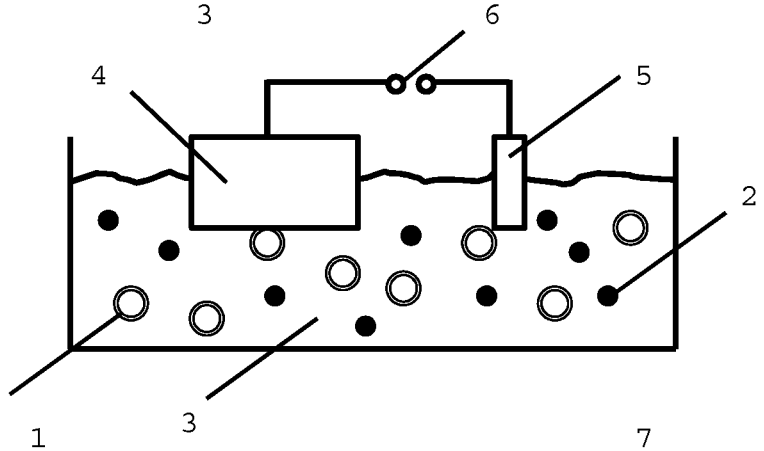
FIG. 2 a cross-sectional view of an electrolyte bath dispersed according to the invention during the electrodeposition of a layer on a component to be coated.

FIG. 2 shows the electrolyte bath shown in FIG. 1 during the electrodeposition of a wear-resistant coating according to the invention on a component 4. In this case, the component is connected as cathode to a power supply 6, while an additional anode 5 is arranged in the electrolyte bath.

Figure 3:
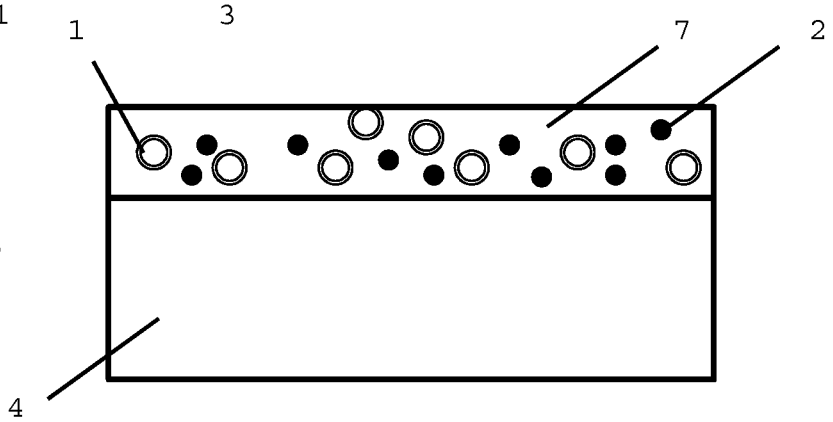
FIG. 3 a cross section through a component with a layer deposited according to the invention; and in FIG. 4 a cross section through a component with a wear-resistant coating deposited according to the invention after a heat treatment.

FIG. 3 shows the component 4 with the deposited layer 7, which comprises an NiCo matrix with incorporated first particles 1 and second particles 2. The current density during the electrodeposition can lie in the range of from 1 to 10 $A/dm^2$.

The deposited layer 7 is subjected together with the component 4 to a heat treatment, to be precise in a temperature range of 1000° C. to 1150° C. for 5 to 15 hours in vacuo, such that the second particles 2 of a CrAl alloy together with the CoNi matrix of the deposited layer form a CoNiCrAl matrix, in which hard material particles 9*a* of chromium oxide and/or zirconium oxide and slip material particles 9*b* of hexagonal boron nitride are present in the CoNiCrAl matrix, in order to form the wear-resistant coating 10 on the component 4.

If, for example, a CrAlY alloy is used for the second particles 2, a CoNiCrAlY matrix 8 of the wear-resistant coating 10 is formed.

Figure 4:
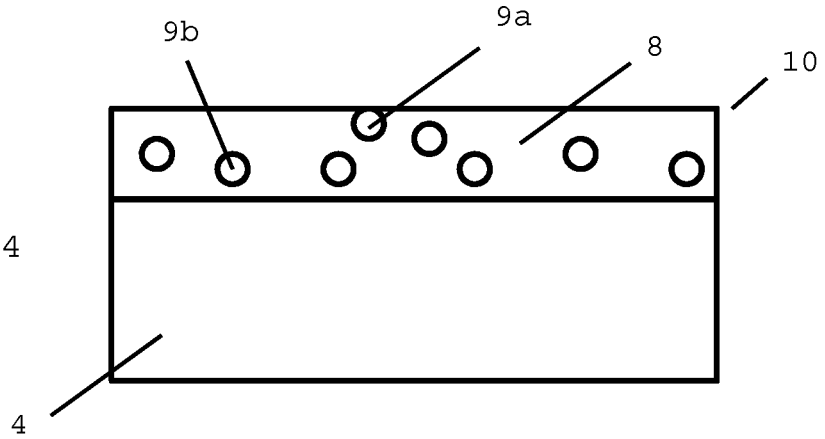

In the case of the exemplary embodiment shown in FIGS. 1 to 4, the first particles 1 are provided with a metal shell of nickel and/or cobalt; this dissolves in the matrix 8 during the heat treatment step between FIGS. 3 and 4, and therefore the hard material particles 9*a* and the slip material particles 9*b* are present in the wear-resistant coating 10 without a surrounding shell.

While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A coating, wherein the coating is wear-resistant and comprises an electrodeposited matrix which comprises from 15% by weight to 50% by weight Co, from 15% by weight to 50% by weight Ni, from 10% by weight to 30% by weight Cr, and from 1% by weight to 10% by weight Al, and in which first particles comprising hard material particles and/or slip material particles are incorporated in a proportion of from 5% by volume to 40% by volume.

2. The wear-resistant coating of claim 1, wherein the coating comprises the hard material particles and/or slip material particles in a proportion of from 10% by volume to 30% by volume.

3. The wear-resistant coating of claim 1, wherein the matrix comprises from 20% by weight to 40% by weight Co, from 20% by weight to 40% by weight Ni, from 10% by weight to 25% by weight Cr and from 2% by weight to 8% by weight Al.

4. The wear-resistant coating of claim 1, wherein the first particles have a maximum or average particle size of less than or equal to 10 μm.

5. The wear-resistant coating of claim 1, wherein the slip material particles comprise a solid lubricant.

6. The wear-resistant coating of claim 5, wherein the solid lubricant comprises hexagonal boron nitride.

7. The wear-resistant coating of claim 1, wherein the hard material particles comprise oxides.

8. The wear-resistant coating of claim 7, wherein the hard material particles comprise chromium oxide and/or zirconium oxide.

9. The wear-resistant coating of claim 1, wherein the first particles comprise hard material particles and slip material particles.

10. The wear-resistant coating of claim 9, wherein the slip material particles comprise a solid lubricant and the hard material particles comprise oxides.

11. The wear-resistant coating of claim 10, wherein the slip material particles comprise hexagonal boron nitride.

12. The wear-resistant coating of claim 10, wherein the hard material particles comprise chromium oxide and/or zirconium oxide.

13. A coating, wherein the coating is wear-resistant and comprises an electrodeposited matrix which comprises from 15% by weight to 50% by weight Co, from 15% by weight to 50% by weight Ni, from 10% by weight to 30% by weight Cr, and from 1% by weight to 10% by weight Al, and in which first particles comprising A hard material particles and/or slip material particles are incorporated in a proportion of from 5% by volume to 40% by volume and wherein the coating has been obtained by a process which comprises:

(a) dispersing the first particles and second particles which comprise metal alloy particles in which the metal alloy comprises chromium and aluminum in an electrolyte which comprises Co and/or Ni;

(b) providing a component to be coated in a bath of the electrolyte which has the first and second particles dispersed therein;

(c) electrodepositing the matrix with incorporated first and second particles on the component; and (d) subjecting the component with the electrodeposited matrix to a heat treatment.

14. The wear-resistant coating of claim 13, wherein the heat treatment is carried out at a temperature of from 950° C. to 1200° C. for from 2 to 20 h.

15. The wear-resistant coating of claim 13, wherein the heat treatment is carried out in vacuo.

16. The wear-resistant coating of claim 13, wherein the electrolyte comprises $NiSO_4$ and/or $CoSO_4$.

17. The wear-resistant coating of claim 13, wherein the electrolyte comprises NaCl and/or $H_3BO_3$.

18. The wear-resistant coating of claim 13, wherein the first and second particles are each provided in the electrolyte in a proportion of from 50 g/l to 300 g/l.

* * * * *